US012185882B1

(12) United States Patent
Newell

(10) Patent No.: US 12,185,882 B1
(45) Date of Patent: Jan. 7, 2025

(54) DISABLED PERSON TRANSFER SEAT

(71) Applicant: Newell Concepts, Phoenix, AZ (US)

(72) Inventor: Wayne Newell, Phoenix, AZ (US)

(73) Assignee: Newell Concepts, Phoenix, AZ (US)

( * ) Notice: Subject to any disclaimer, the term of this patent is extended or adjusted under 35 U.S.C. 154(b) by 0 days.

(21) Appl. No.: 18/751,104

(22) Filed: Jun. 21, 2024

Related U.S. Application Data

(60) Provisional application No. 63/509,427, filed on Jun. 21, 2023.

(51) Int. Cl.
*A47K 3/28* (2006.01)

(52) U.S. Cl.
CPC ..... *A47K 3/282* (2013.01)

(58) Field of Classification Search
CPC ..... A47K 3/282
USPC ..... 4/611
See application file for complete search history.

(56) References Cited

U.S. PATENT DOCUMENTS 1,298,216 A * 3/1919 Jenkins ..... A47B 37/00 297/344.24
3,142,513 A * 7/1964 Skokut ..... A47C 9/06 4/578.1
3,254,615 A * 6/1966 Gay ..... A61G 7/1059 108/134
5,335,970 A * 8/1994 Bryant ..... A47C 9/06 297/344.22
5,465,437 A 11/1995 Herman
5,477,574 A 12/1995 Skoe
5,647,636 A * 7/1997 Allen ..... A47C 9/06 297/344.21
6,643,861 B2 11/2003 Sherlock et al.
7,197,775 B2 * 4/2007 Steadman ..... A61G 7/1076 4/561.1
9,168,193 B1 10/2015 Simi
9,179,805 B1 * 11/2015 Spratt-Anderson .... A47K 3/127
10,045,665 B1 8/2018 Christmas
2008/0235864 A1 10/2008 Masciarelli
2011/0131720 A1 6/2011 Dean

FOREIGN PATENT DOCUMENTS

EP 1088538 A1 4/2001
GB 2410431 A 8/2005

OTHER PUBLICATIONS https://www.swimming-pool-online.com/F130-wall-mounted-chair-lift.html.
chrome-extension://efaidnbmnnnibpcajpcglclefindmkaj/https://www.handimove.com/assets/pdf/catalog/handimove_catalog_en.pdf.

* cited by examiner

*Primary Examiner* — Huyen D Le
(74) *Attorney, Agent, or Firm* — BOOTH UDALL FULLER, PLC; Kenneth C. Booth

(57) ABSTRACT

A disabled person transfer seat with a first vertically oriented bar with a first horizontal pivot, at least two structural support sections each having upper and lower support bars separated vertically with a brace plate covering a majority of the spaces between them, and a seat, which may be removable, positioned for a disabled person to comfortably sit. The at least two structural support sections are serially coupled to the horizontally pivotally coupled to each other between the first horizontal pivot and the seat, which is also pivotally mounted at a distal end of the vertically mounted to the first horizontal pivot. The removable seat includes a frame, a seat and handles, with an open center and gaps to enable drying of a patient. In some embodiments the structural support sections can nest to enable more compact storage.

20 Claims, 8 Drawing Sheets

DISABLED PERSON TRANSFER SEAT

RELATED APPLICATIONS

This application is a non-provisional patent application and claims the benefit of and priority to U.S. provisional patent application Ser. No. 63/509,427, filed Jun. 21, 2023, to Wayne Newell, titled "ADA Transfer Seat," the entirety of the disclosure of which is hereby incorporated by this reference.

TECHNICAL FIELD

This document relates to an Americans with Disabilities Act ("ADA") compliant transfer seat for use in assisting disabled persons, particularly in relation to showering or baths.

BACKGROUND

Health care providers and other caregivers traditionally have difficulty helping disabled persons who have restricted mobility or weakened muscles to shower or bathe, and then dry off and get dressed. Additionally, helping disabled persons transfer into and out of a shower or bath, or from a wheelchair to a bed or other chair is a known difficulty. Traditional transfer chairs are cumbersome, heavy, difficult to install, can require significant structural changes to a room in which they are installed, and often cannot provide enough support for larger patients.

SUMMARY

Aspects of the present disclosure relate to a disabled person transfer seat comprising a wall plate configured to mount to a wall of a building, a first vertically oriented bar mounted to the wall plate and having at least a first horizontal pivot adjacent the wall plate, a first structural support section vertically mounted to the first horizontal pivot, the first structural support section comprising a first upper support bar, a first lower support bar separated vertically from the first upper support bar, and a first brace plate that covers a majority of a first space between the first upper support bar and the first lower support bar, and a second horizontal pivot at an end of the first structural support section opposite the first horizontal pivot, a second structural support section vertically mounted to the second horizontal pivot, the second structural support section comprising a second upper support bar, and a second lower support bar separated vertically from the second upper support bar, and a second brace plate that covers a majority of a second space between the second upper support bar and the second lower support bar, and a seat mount support on an end of the second structural support section opposite the second horizontal pivot, the seat mount support having seat post receiving hole extending through at least an upper surface of the seat mount support, wherein the second structural support section is vertically smaller than the first structural support section, and a removable seat comprising: a seat frame having a seat post extending downward therefrom and configured to be supported on the seat mount support with the seat post removably extending into the seat post receiving hole, a seat body coupled to the seat frame and having leg supports positioned to support a disabled person sitting on the seat body, and an open center, and first and second hand rails respectively coupled to opposing sides of the seat frame adjacent left and right sides of the seat body, wherein the hand rails positioned to provide a gap between the seat frame and the respective first and second hand rails, wherein the removable seat is horizontally pivotally coupled to the seat mount support and the first structural support section and the second structural support section are configured to pivotally rotate in relation to each other to a position where a majority of the second structural support section is nested within the first structural support section.

Particular embodiments may comprise one or more of the following features. The seat mount support may be removably coupled to a vertical end bar extending between the second upper support bar and the second lower support bar. The seat mount support may further have a square post, the vertical end bar having a square post receiver attached thereto, and wherein the seat mount support is removably coupled to the vertical end bar through the square post being removably received into the square post receiver. The seat mount support may further comprise a locking pin having a locked position and an unlocked position, wherein in the locked position the square post is unremovable from the square post receiver and in the unlocked position the square post is removable from the square post receiver. The first lower support bar may be longer than the first upper support bar, the second lower support bar is longer than the second upper support bar, the first upper support bar is not parallel to the first lower support bar and the second upper support bar is not parallel to the second lower support bar. The first horizontal pivot may comprise a first horizontal upper pivot at an end of the first upper support extending around the first vertically oriented mount bar mounted and a first horizontal lower pivot at an end of the first lower support extending around the first vertically oriented mount bar. The second horizontal pivot may comprise a second vertically oriented bar, a second horizontal upper pivot at an end of the second upper support extending around the second vertically oriented bar and a second horizontal lower pivot at an end of the second lower support extending around the second vertically oriented bar.

Aspects of the disclosure relate to a disabled person transfer seat comprising a first vertically oriented bar configured to mount to a support in a building and having at least a first horizontal pivot, a first structural support section vertically mounted to the first horizontal pivot, the first structural support section comprising a first upper support bar, a first lower support bar separated vertically from the first upper support bar, and a first brace plate spanning a distance between the first upper support bar and the first lower support bar, and a second horizontal pivot at an end of the first structural support section opposite the first horizontal pivot, a second structural support section vertically mounted to the second horizontal pivot, the second structural support section comprising a second upper support bar, a second lower support bar separated vertically from the second upper support bar, and a second brace plate spanning a distance between the second upper support bar and the second lower support bar, and a seat mount support on an end of the second structural support section opposite the second horizontal pivot, the seat mount support having seat post receiving hole, and a removable seat comprising: a seat frame having a seat post configured to be supported on the seat mount support with the seat post removably extending into the seat post receiving hole, a seat body coupled to the seat frame and having an open center, and first and second hand rails respectively coupled to opposing sides of the seat frame, wherein the removable seat is horizontally pivotally coupled to the seat mount support, and the first structural support section and the second structural support section are configured to pivotally rotate in relation to each other to a position where at least a portion of the second structural support section is nested inside a portion of the first structural support section.

Particular embodiments may comprise one or more of the following features. The first brace plate may cover a majority of a first vertical space between the first upper support bar and the first lower support bar. The second brace plate may cover a majority of a second vertical space between the second upper support bar and the second lower support bar. The second structural support section may be vertically smaller than the first structural support section. The seat mount support may be removably coupled to a vertical end bar extending between the second upper support bar and the second lower support bar. The seat mount support may further have a square post, the vertical end bar having a square post receiver attached thereto, and wherein the seat mount support is removably coupled to the vertical end bar through the square post being removably received into the square post receiver. The first lower support bar may be longer than the first upper support bar, the second lower support bar may be longer than the second upper support bar, the first upper support bar is not parallel to the first lower support bar and the second upper support bar is not parallel to the second lower support bar.

Aspects of the disclosure relate to a disabled person transfer seat comprising a first vertically oriented bar having at least a first horizontal pivot, a first structural support section vertically mounted to the first horizontal pivot, the first structural support section comprising a first upper support bar, a first lower support bar, and a first brace plate spanning a vertical distance between the first upper support bar and the first lower support bar, and a second horizontal pivot at an end of the first structural support section opposite the first horizontal pivot, a second structural support section vertically mounted to the second horizontal pivot, the second structural support section comprising a second upper support bar, a second lower support bar, and a second brace plate spanning a vertical distance between the second upper support bar and the second lower support bar, and a seat mount support on an end of the second structural support section opposite the second horizontal pivot, and a removable seat horizontally pivotally coupled to the seat mount support.

Particular embodiments may comprise one or more of the following features. The removable seat may further comprise a seat frame removably coupled to the seat mount support, a seat body coupled to the seat frame and having an open center, and first and second hand rails respectively coupled to opposing sides of the seat frame. The first structural support section and the second structural support section may be configured to pivotally rotate in relation to each other to a position where at least a portion of the second structural support section is nested within a portion of the first structural support section. The first brace plate may cover a majority of a first vertical space between the first upper support bar and the first lower support bar, and wherein the second brace plate may cover a majority of a second vertical space between the second upper support bar and the second lower support bar. The seat mount support may further have a square post, the vertical end bar may have a square post receiver attached thereto, and the seat mount support may be removably coupled to the vertical end bar through the square post being removably received into the square post receiver. The first lower support bar may be longer than the first upper support bar, the second lower support bar may be longer than the second upper support bar, the first upper support bar may be not parallel to the first lower support bar and the second upper support bar may be not parallel to the second lower support bar.

The foregoing and other aspects, features, and advantages will be apparent from the DESCRIPTION and DRAWINGS, and from the CLAIMS if any are included.

BRIEF DESCRIPTION OF THE DRAWINGS

Implementations will hereinafter be described in conjunction with the appended and/or included DRAWINGS, where like designations denote like elements, and.

DETAILED DESCRIPTION

Figure 1:
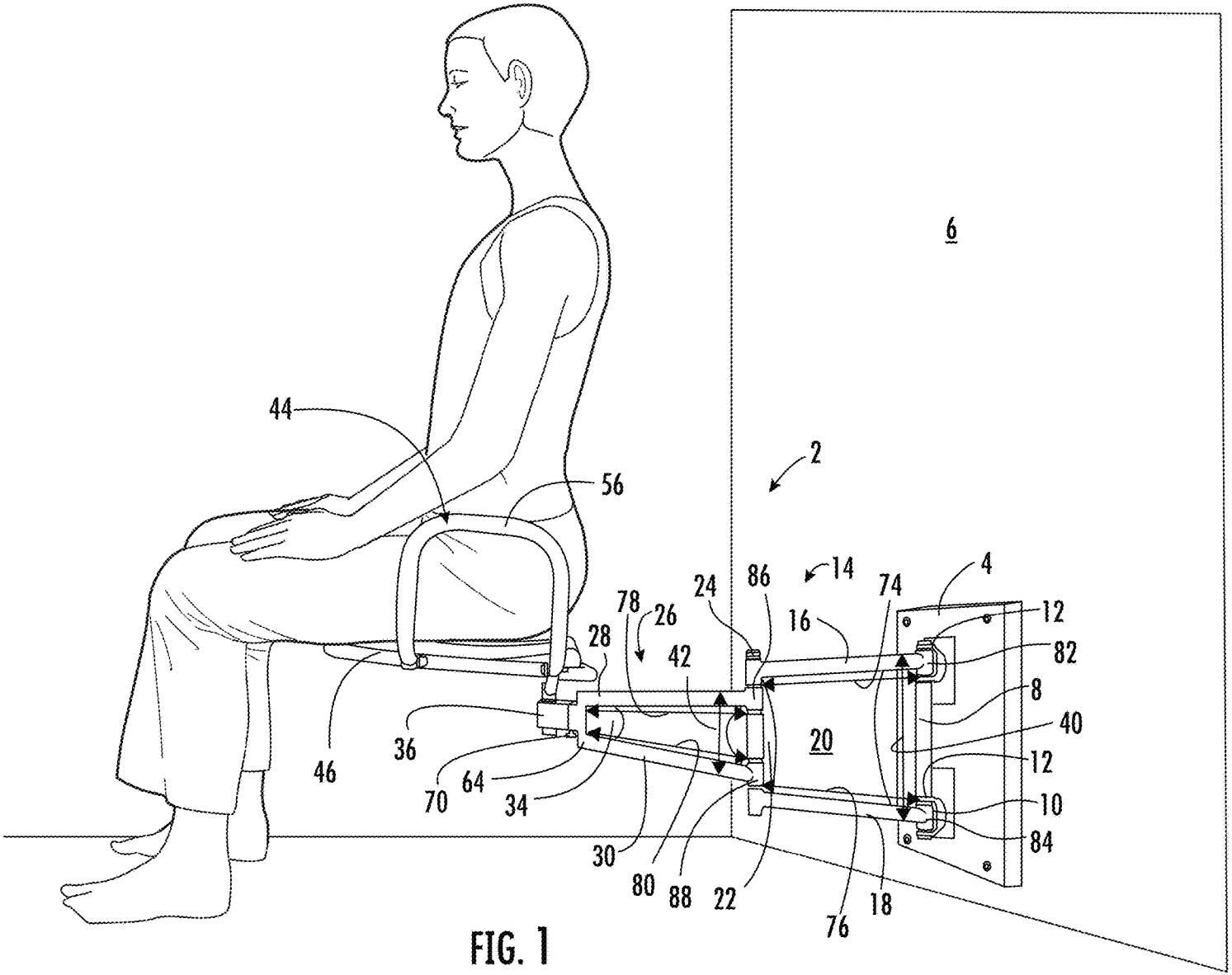
FIG. 1 is a side view of a transfer seat in an extended position with a disabled person seated upon it.

Detailed aspects and applications of the disclosure are described below in the following drawings and detailed description of the technology. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the disclosure. It will be understood, however, by those skilled in the relevant arts, that embodiments of the technology disclosed herein may be practiced without these specific details. It should be noted that there are many different and alternative configurations, devices and technologies to which the disclosed technologies may be applied. The full scope of the technology disclosed herein is not limited to the examples that are described below.

The singular forms "a," "an," and "the" include plural referents unless the context clearly dictates otherwise. Thus, for example, reference to "a step" includes reference to one or more of such steps.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Throughout the description and claims of this specification, the words "comprise" and "contain" and variations of the words, for example "comprising" and "comprises", mean "including but not limited to", and are not intended to (and do not) exclude other components.

As required, detailed embodiments of the present disclosure are included herein. It is to be understood that the disclosed embodiments are merely exemplary of the invention that may be embodied in various forms. Therefore, specific structural and functional details disclosed herein are not to be interpreted as limits, but merely as a basis for teaching one skilled in the art to employ the present invention. The specific examples below will enable the disclosure to be better understood. However, they are given merely by way of guidance and do not imply any limitation.

The present disclosure may be understood more readily by reference to the following detailed description taken in connection with the accompanying figures and examples, which form a part of this disclosure. It is to be understood that this disclosure is not limited to the specific materials, devices, methods, applications, conditions, or parameters described and/or shown herein, and that the terminology used herein is for the purpose of describing particular embodiments by way of example only and is not intended to be limiting of the claimed inventions. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Embodiments of transfer seats disclosed herein are particularly useful in wet environments, like for transferring into and out of a shower or bath area due to the dangers of slipping on wet surfaces while attempting to move a patient. Slip injuries are reported every year by caregivers assisting patients in and out of bathrooms. The materials used for various particular embodiments of a transfer seat disclosed herein are water resistant and rust resistant or rust proof, and can withstand exposure to water. Embodiments disclosed herein are particularly useful in assisting elderly patients to the shower from a wheelchair, helping them shower, then helping them dry off and exit the shower.

Although component sizes, shapes, and arrangements may vary for each particular implementation of a transfer seat 2, with reference to FIG. 1, disabled person transfer seats constructed according to the present disclosure may be coupled to a structure 6 of a building, such as a wall or support mounted within a room, through a wall plate 4 mounted to the wall 6, or by attaching horizontal pivot clamps 12 to the structure 6. In cases of new construction, backer may be installed prior to drywall or tile for additional structural support, however this is optional and not required.

In the embodiment illustrated in FIG. 1, horizontal pivot clamps 12 are attached to a wall plate 4 that is attached to a wall 6 of a bathroom adjacent a shower. A first vertically oriented bar 8 is mounted to the horizontal pivot clamps 12 which extend around the vertically oriented bar 8 and form a basis for a first horizontal pivot 10 to enable a first structural support section 14 to pivot about the horizontal pivot 10 adjacent to the wall 6.

The first structural support section 14 includes a first upper support bar 16 and a first lower support bar 18 separated from the first upper support bar 16 by a first space 22 extending between them. A first brace plate 20 extends from the first upper support bar 16 to the first lower support bar 18 and may be attached to each of them along a majority of their respective lengths 74, 76, so that a majority of the first space 22 is covered by the first brace plate 20. The entire first structural support section 14 may be configured to pivot horizontally about the first horizontal pivot 10 without interference except where it contacts a wall 6 or other structure in the room. The first structural support section 14 may be coupled to the first horizontal pivot 10 through a first horizontal upper pivot 82 and a first horizontal lower pivot 84 pivotally coupling to the first horizontal pivot 10 and extending around the first horizontal pivot 10. A second horizontal pivot 24 is included at an end of the first structural support section 14 opposite the first horizontal pivot 10.

A second structural support section 26 includes a second upper support bar 28 and a second lower support bar 30 separated from the second upper support bar 28 by a second space 34 extending between them. A second brace plate 32 extends from the second upper support bar 28 to the second lower support bar 30 and may be attached to each of them along a majority of their respective lengths 78, 80, so that a majority of the second space 34 is covered by the second brace plate 32. The entire second structural support section 26 may be configured to pivot horizontally about the second horizontal pivot 24 without interference except where it contacts the first structural support section, the first horizontal pivot 10, a wall 6 or other structure in the room. The second structural support section 26 may be coupled to the second horizontal pivot 24 through a second horizontal upper pivot 86 and a second horizontal lower pivot 88 pivotally coupling to the second horizontal pivot 24 and extending around the second horizontal pivot 24. A vertical end bar 64 may be included at an end of the second structural support section 26 opposite the second horizontal pivot 24.

Figure 4B:
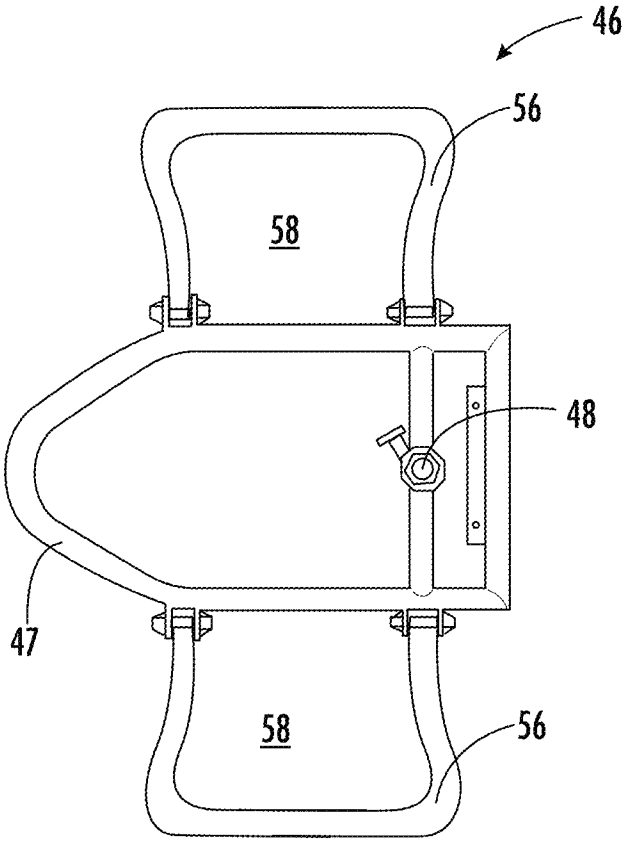
FIGS. 4A and 4B are, respectively, a side view and a top view of a seat frame for use with a transfer seat.
Figure 4A:
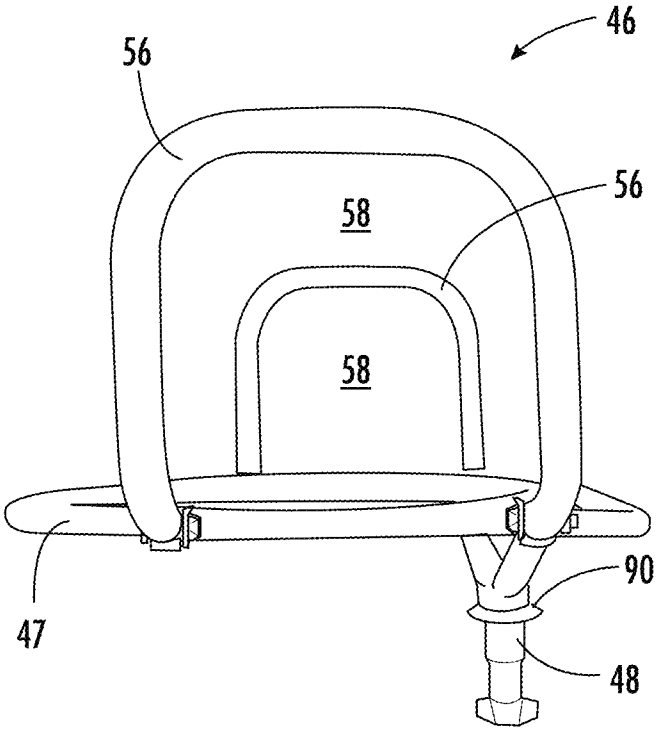
Figure 5B:
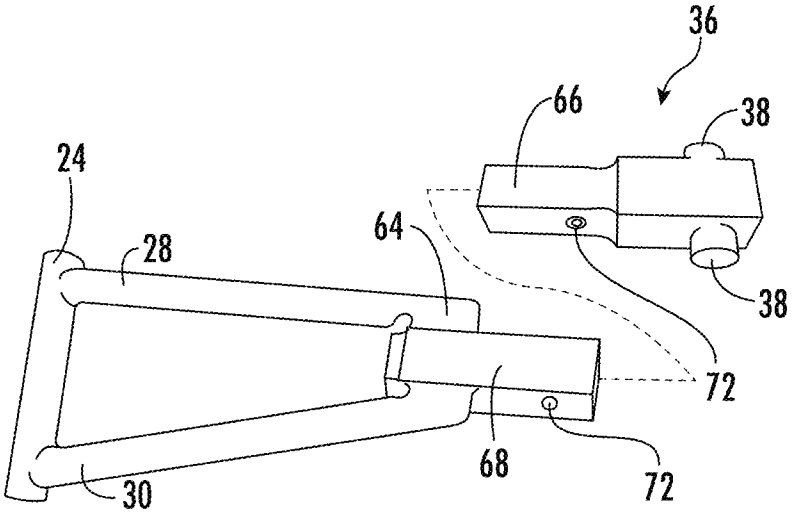
FIGS. 5A and 5B are side views of a second structural support section of a transfer seat with a seat mount support in, respectively, an attached position and a detached position.
Figure 5A:
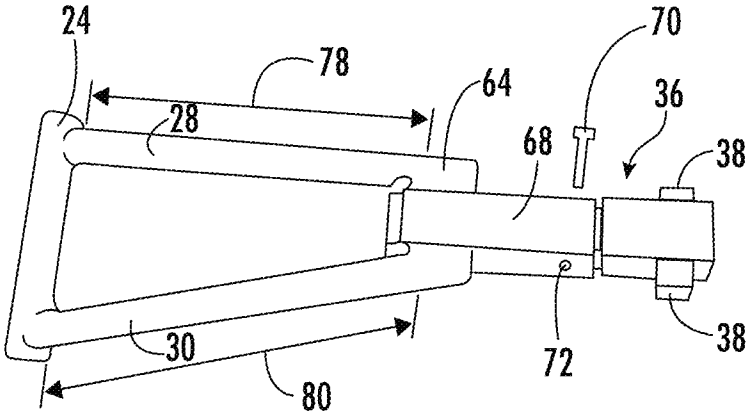

A removable seat 44 is mounted to the end of the second structurally support section 26 opposite the second horizontal pivot 24. The removable seat 44 may be mounted using a seat mount support 36 or some other support. FIGS. 5A and 5B represent the second structural support section 26 with the second brace plate 32 (FIG. 1) removed and the seat mount support 36 connected (FIG. 5A) and disconnected (FIG. 5B). The seat mount support 36 may connect to the second structural support section 26 similar to a trailer hitch with a post 66 (for example a square post on the seat mount support 36) inserted into a post receiver 68 (for example a square post receiver on the second structural support section 26), and locked into place with a locking pin 70 extending through a locking pin aperture 72 that extends through a surface of both the post receiver 68 and the post 66. As illustrated in FIGS. 5A and 5B, the post receiver 68 may form the vertical end bar 64. FIG. 5A shows the unlocked position with the locking pin 70 removed, and FIG. 1 shows the locked position with the locking pin 70 in place and the post 66 is unremovable from the post receiver 68. A seat post 48 extending downward from the seat frame 46 (FIGS. 4A, 4B) may be mounted to the seat mount support 36 by insertion into a seat post receiving hole 38 extending through at least one, and in some cases, as illustrated in FIGS. 5A-5B, both surfaces of the seat mount support 36.

The removable seat 44 is configured to pivot about its mounting to the seat mount support 36. The pivot motion may be arranged by the seat post 48 pivoting within the seat mount support 36, or as illustrated in the Figures, a separate pivoting structure 90 may be provided between the seat frame 46 and the seat post 48. When a separate pivoting structure 90 is provided, the seat post 48 may be seated firmly within the seat mount support 36 and the seat frame 46 pivots in relation to the seat post 48 at the separate pivoting structure 90. In any case, the removable seat is configured to pivot about an axis in relation to the second structural support section 26.

The removable seat 44 is removable from the second structural support section 26 either through removing the seat post 48 from the seat mount support 36, or through removing the seat mount support 36 from the second structural support section 26. Removal of the removable seat allows for more compact storage when not in use so that it does not obstruct free use of the room in which it is mounted when not in use. Having a seat being removable from the rest of the transfer seat construction, the seat section can be mounted on any frame construction, and other seat configurations can be mounted to the transfer seat, or seats for differently sized people or more easily replaced if it gets worn or outdated. The removable seat 44 may also be swapped out for an alternate seat more suitable for different activities.

With reference to FIGS. 2-4B, the removable seat 44 includes a seat frame 46 that includes the seat post 48, hand rails 56 that extend upward from the seat frame 46, and a seat support 47. A seat body 50, including leg supports 52 and an open center, is mounted on the seat frame 46 between the hand rails 56. Gaps 58 are included between each of the hand rails 56 and the frame 46. When in use, the open center 54 of the seat body 50 and the gaps 58 between the hand rails 56 and the seat frame 46 enable a caregiver to access more parts of a patient seated in the transfer seat because the gaps 58 allow the caregiver to reach and towel off a patient from the side, and the open center 54 allows the caregiver to reach and towel off a patient from below. This is particularly useful when the caregiver is assisting the patient after a shower.

Embodiments of a transfer seat 2 may be built from heavy gage, rigid, aluminum tubing, solid aluminum plates (e.g. ½"), heavy duty plastic pivot bushings and stainless steel materials. In particular embodiments it may be constructed of non-corrosive materials. In such embodiments, the transfer seat can be completely submerged in water due to the waterproof design. Embodiments of a transfer seat 2 may be powder coated with heavy duty coating that helps keep the seat easy to clean and maintain. The rigid aluminum tubing and brace plates provide a strong frame that allows the seat to be sturdy with just enough flexibility for suspension of overweight people. The seat enables health care providers the ability to transfer patients in and out of areas that are typically difficult for providers to move patients from safety.

Figure 2:
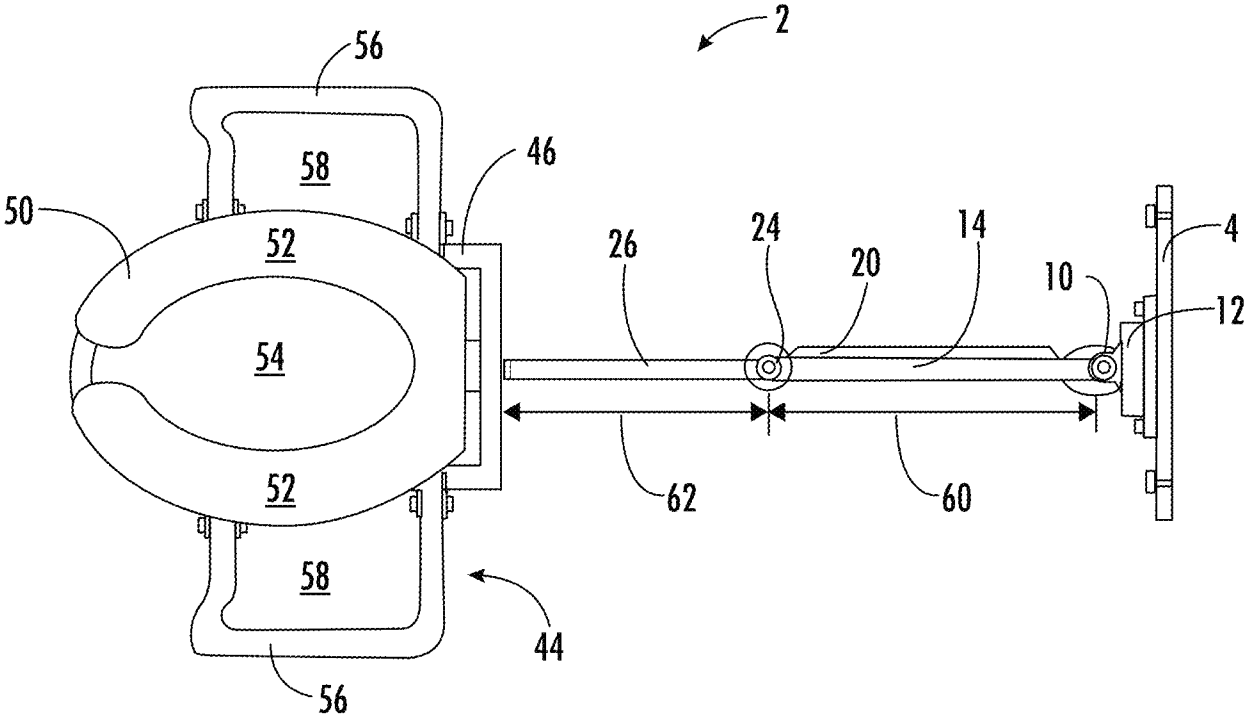
FIG. 2 is top view of the transfer seat of FIG. 1 in the extended position.
Figure 3A:
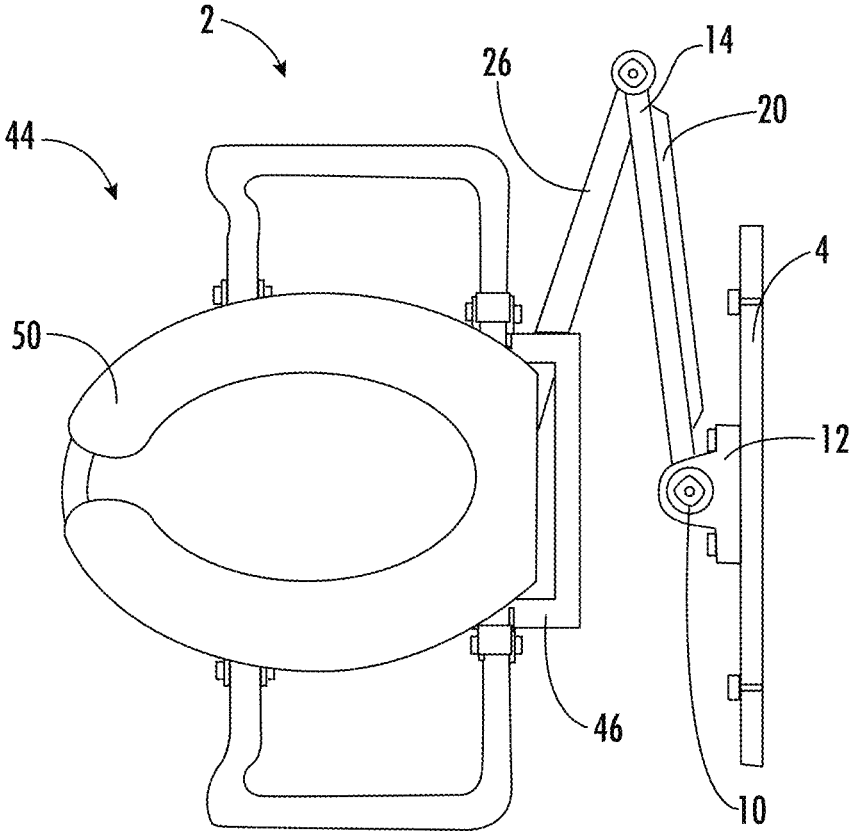
FIGS. 3A and 3B are top views of the transfer seat of FIG. 1 in, respectively, a partially retracted and fully retracted position.
Figure 3B:
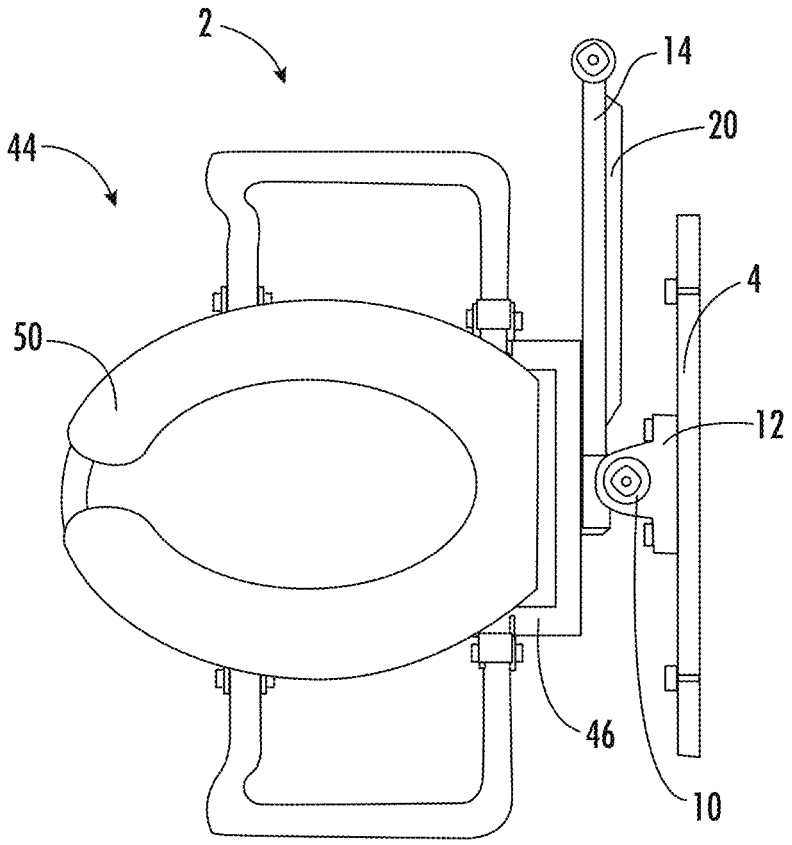

By providing two structural support sections 14,26 pivotally coupled between the wall plate 4 and the removable seat 44, the transfer seat 2 can be collapsed to store more compactly against the wall 6 to which it is mounted as shown in FIGS. 3A and 3B. Inclusion of pivoting joints at each coupling permits the compact storage as well as more options for movement of the patient. In particular embodiments, as illustrated in FIGS. 1-3, the first brace plate 20 is offset from a center of the first structural support section to further enhance the compactness of the design for storage. By offsetting the first brace plate 20 so that it extends toward the wall when stored, the second structural support section 26 can at least partially nest within the first structural support section 14 when the transfer seat 2 is fully collapsed, with a majority of a length of the second structural support section 62 being nested within the length of the first structural support section 60. FIG. 3A illustrates the transfer seat 2 moving toward its fully collapsed position, and FIG. 3B illustrates the transfer seat 2 fully collapsed with the second structural support section 26 nesting within the first structural support section 14. With reference to FIG. 1, because the second structural support section 26 has a second vertical height 42 smaller than the first vertical height 40 of the first structural support section 14, not only is the second structural support section 26 less obtrusive, it also can nest within the first structural support section 26 when collapsed.

Figure 6B:
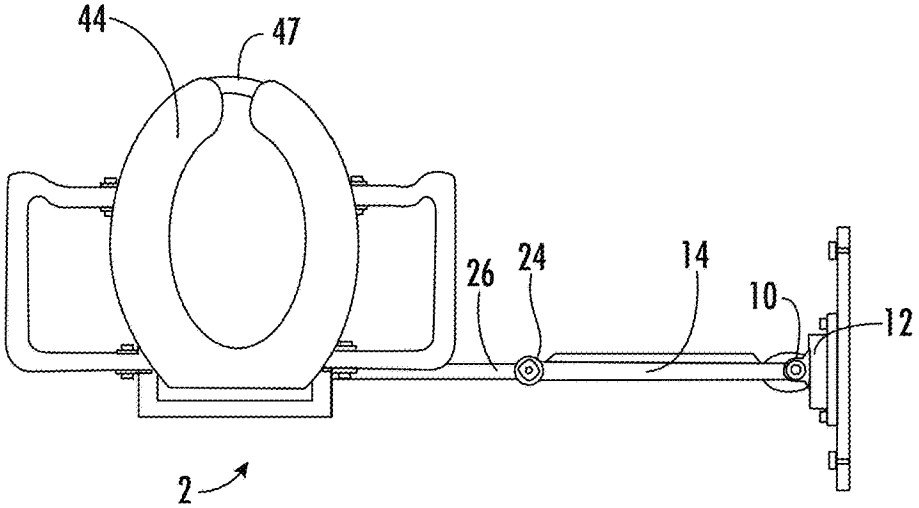
FIGS. 6A-6C are top views of the transfer seat of FIG. 1 in various positions.
Figure 6A:
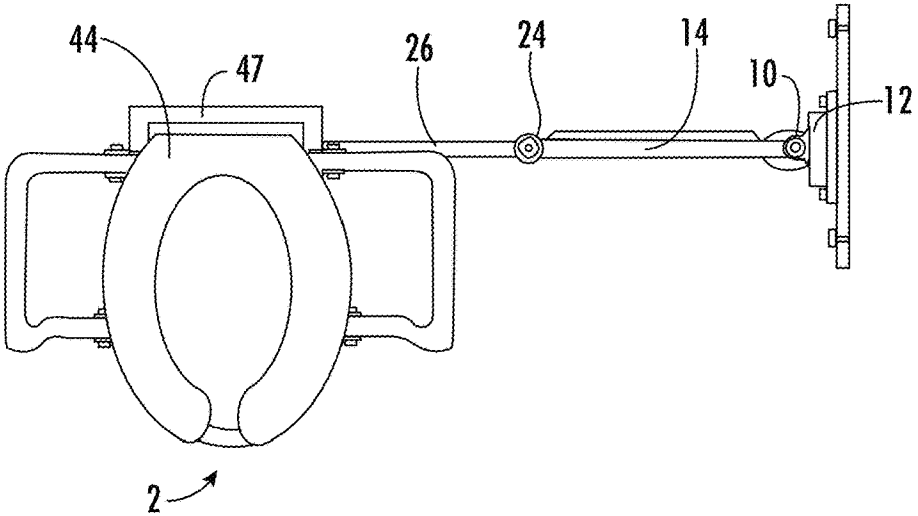
Figure 6C:
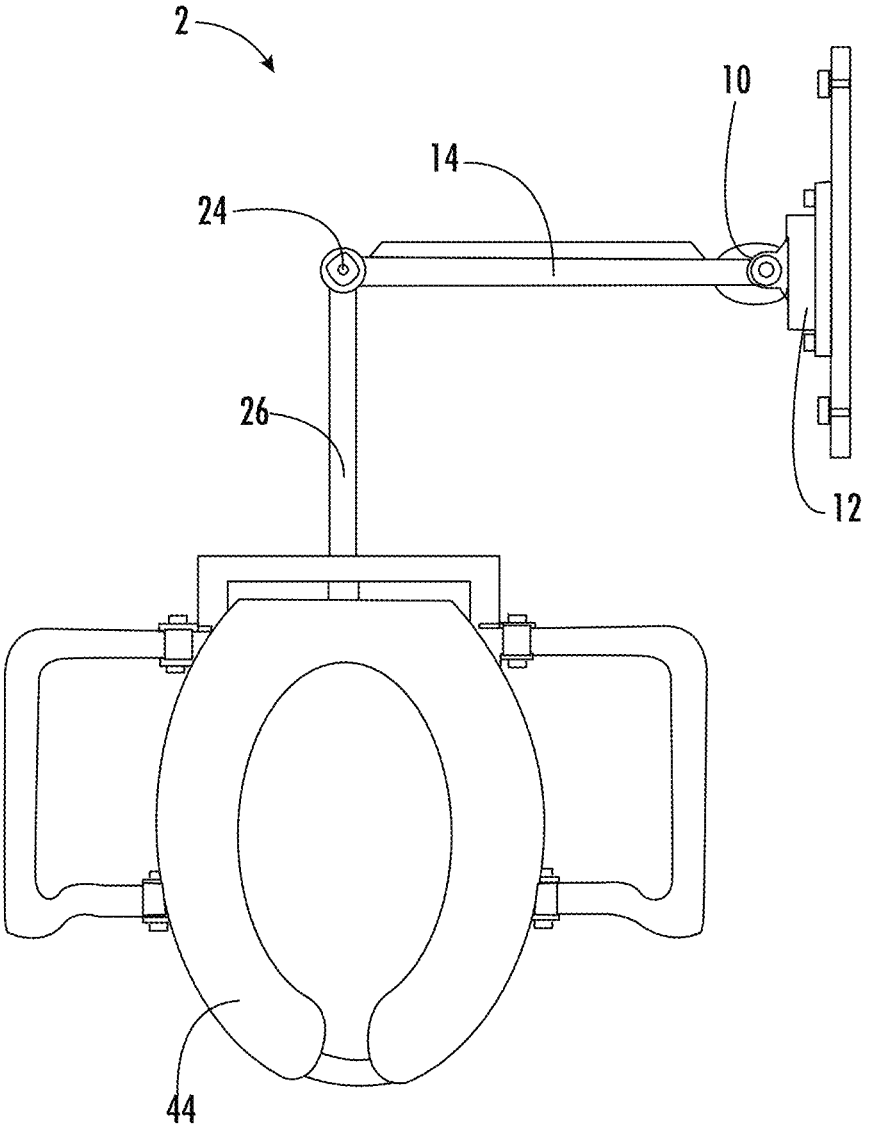

FIGS. 6A-6B illustrate the removable seat 44 pivoting at least 170 degrees back and forth in relation to the second structural support section 26. FIG. 6C shows the second structural support section 26 pivoting 90 degrees in relation to the first structural support section 14. These illustrate some of the useful movements that may be accomplished through the inclusion of at least three pivot points for the transfer seat 2. In some embodiments additional pivot points and structural support sections are contemplated that can further at least partially nest within each other similar to the second structural support section 26 nesting within the first structural support section 14. Nevertheless, for most situations, two structural support sections and three pivot points is sufficient. The wide range of motion provided for all of the sections provides additional configurable positions for a disabled person transfer seat constructed according to this disclosure that are particularly helpful in moving a patient.

Aspects of the disclosure increase the structural strength and versatility of a transfer seat 2. For example, the use of both an upper support bar 16, 28 and a lower support bar 18, 30 and a brace plate 20, 32 extending between them in each structural support section 14, 26 enables lighter-weight materials to support greater weighted people through added rigidity of design. Furthermore, as will be noted in FIGS. 1 and 5A-5B in particular, in particular embodiments a first upper support bar length 74 is shorter than first lower support bar length 76, because the first lower support bar 18 is angled more than the first upper support bar 16. This non-parallel configuration of the support bars 16, 18 with the first brace plate 20 structurally tying them together, provides added rigidity and strength against sagging when a heavy person sits on the transfer seat 2. Similarly, in particular embodiments a second upper support bar length 78 is shorter than a second lower support bar length 80 with the support bars 28, 30 being non-parallel and the second brace plate 32 structurally tying them together to provide added structural rigidity and strength.

In addition to conveniently assisting in moving a patient, another particular benefit of the transfer seat comes in the health care attendant's interactions with the patient in helping the patient get ready for the day. Because the removable seat 44 includes open areas for drying a patient and allows the health care worker to reach all areas of the patient, and because the seat section can be pivotally and spatially manipulated respectively in relation to the adjacent second structural support section and the wall, other patient preparation activities are made easier than with conventional seats. Several non-limiting examples of such activities and how a transfer seat constructed according to the present disclosure is used for such activities are described here. Once a person seated in the seat is done showering, the caregiver can dry the person top to bottom without having the person have to stand in a wet area with risk of slipping. The caregiver can start putting on the person's underclothing, socks, pants, shoes and shirt in a safe, dry environment. At some point, the person can stand and the caregiver can raise the person's underclothing and pants without the person needing to move other than to stand up. When the person is ready to move to their wheelchair, the person can simply stand in place, the caregiver can move the transfer chair out of the way and put the person's wheelchair behind them for the person to sit in, without needing to move locations or risk falling due to tripping or inability to move their feet.

Embodiments of a transfer seat according to the present disclosure can be installed quickly and used the same day without structural changes needed to a home, and without taking up a significant area in a bathroom or bedroom for large equipment. The components used are simple, non-motorized, and non-electrical. No training is needed to be able to install or use the transfer seat. The transfer seat is able to be installed in wet or dry areas without maintenance or repair and collapses to a small storage space. It is usable in tight spaces as well as large spaces.

This disclosure, its aspects and embodiments, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

It will be understood that implementations of a disabled person transfer seat include but are not limited to the specific components disclosed herein, as virtually any components consistent with the intended operation of various disabled person transfer seats may be utilized. Accordingly, for example, it should be understood that, while the drawings and accompanying text show and describe particular disabled person transfer seat implementations, any such implementation may comprise any shape, size, style, type, model, version, class, grade, measurement, concentration, material, weight, quantity, and/or the like consistent with the intended operation of a disabled person transfer seat.

The concepts disclosed herein are not limited to the specific disabled person transfer seats shown herein. For example, it is specifically contemplated that the components included in particular disabled person transfer seats may be formed of any of many different types of materials or combinations that can readily be formed into shaped objects and that are consistent with the intended operation of a disabled person transfer seat. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, disabled person transfer seats may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular disabled person transfer seat implementations, it should be readily apparent that a number of modifications may be made without departing from the spirit thereof and that these implementations may be applied to other implementations disclosed or undisclosed. The presently disclosed disabled person transfer seats are, therefore, to be considered in all respects as illustrative and not restrictive.

Many additional implementations are possible. Further implementations are within the CLAIMS.

I claim:

1. A disabled person transfer seat comprising:

a wall plate configured to mount to a wall of a building;

a first vertically oriented bar mounted to the wall plate and having at least a first horizontal pivot adjacent the wall plate;

a first structural support section vertically mounted to the first horizontal pivot, the first structural support section comprising a first upper support bar, a first lower support bar separated vertically from the first upper support bar, and a first brace plate that covers a majority of a first space between the first upper support bar and the first lower support bar, and a second horizontal pivot at an end of the first structural support section opposite the first horizontal pivot;

a second structural support section vertically mounted to the second horizontal pivot, the second structural support section comprising a second upper support bar, and a second lower support bar separated vertically from the second upper support bar, and a second brace plate that covers a majority of a second space between the second upper support bar and the second lower support bar, and a seat mount support on an end of the second structural support section opposite the second horizontal pivot, the seat mount support having seat post receiving hole extending through at least an upper surface of the seat mount support, wherein the second structural support section is vertically smaller than the first structural support section; and a removable seat comprising:

a seat frame having a seat post extending downward therefrom and configured to be supported on the seat mount support with the seat post removably extending into the seat post receiving hole;

a seat body coupled to the seat frame and having leg supports positioned to support a disabled person sitting on the seat body, and an open center; and first and second hand rails respectively coupled to opposing sides of the seat frame adjacent left and right sides of the seat body, wherein the hand rails positioned to provide a gap between the seat frame and the respective first and second hand rails;

wherein the removable seat is horizontally pivotally coupled to the seat mount support and the first structural support section and the second structural support section are configured to pivotally rotate in relation to each other to a position where a majority of the second structural support section is nested within the first structural support section.

2. The disabled person transfer seat of claim 1, wherein the seat mount support is removably coupled to a vertical end bar extending between the second upper support bar and the second lower support bar.

3. The disabled person transfer seat of claim 2, wherein the seat mount support further having a square post, the vertical end bar having a square post receiver attached thereto, and wherein the seat mount support is removably coupled to the vertical end bar through the square post being removably received into the square post receiver.

4. The disabled person transfer seat of claim 3, wherein the seat mount support further comprising a locking pin having a locked position and an unlocked position, wherein in the locked position the square post is unremovable from the square post receiver and in the unlocked position the square post is removable from the square post receiver.

5. The disabled person transfer seat of claim 1, wherein the first lower support bar is longer than the first upper support bar, the second lower support bar is longer than the second upper support bar, the first upper support bar is not parallel to the first lower support bar and the second upper support bar is not parallel to the second lower support bar.

6. The disabled person transfer seat of claim 1, wherein the first horizontal pivot comprises a first horizontal upper pivot at an end of the first upper support extending around the first vertically oriented mount bar mounted and a first horizontal lower pivot at an end of the first lower support extending around the first vertically oriented mount bar.

7. The disabled person transfer seat of claim 1, wherein the second horizontal pivot comprises a second vertically oriented bar, a second horizontal upper pivot at an end of the second upper support extending around the second vertically oriented bar and a second horizontal lower pivot at an end of the second lower support extending around the second vertically oriented bar.

8. A disabled person transfer seat comprising:

a first vertically oriented bar configured to mount to a support in a building and having at least a first horizontal pivot;

a first structural support section vertically mounted to the first horizontal pivot, the first structural support section comprising a first upper support bar, a first lower support bar separated vertically from the first upper support bar, and a first brace plate spanning a distance between the first upper support bar and the first lower support bar, and a second horizontal pivot at an end of the first structural support section opposite the first horizontal pivot;

a second structural support section vertically mounted to the second horizontal pivot, the second structural support section comprising a second upper support bar, a second lower support bar separated vertically from the second upper support bar, and a second brace plate spanning a distance between the second upper support bar and the second lower support bar, and a seat mount support on an end of the second structural support section opposite the second horizontal pivot, the seat mount support having seat post receiving hole; and a removable seat comprising:

a seat frame having a seat post configured to be supported on the seat mount support with the seat post removably extending into the seat post receiving hole;

a seat body coupled to the seat frame and having an open center; and first and second hand rails respectively coupled to opposing sides of the seat frame;

wherein the removable seat is horizontally pivotally coupled to the seat mount support, and the first structural support section and the second structural support section are configured to pivotally rotate in relation to each other to a position where at least a portion of the second structural support section is nested inside a portion of the first structural support section.

9. The disabled person transfer seat of claim 8, wherein the first brace plate covers a majority of a first vertical space between the first upper support bar and the first lower support bar.

10. The disabled person transfer seat of claim 8, wherein the second brace plate covers a majority of a second vertical space between the second upper support bar and the second lower support bar.

11. The disabled person transfer seat of claim 8, wherein the second structural support section is vertically smaller than the first structural support section.

12. The disabled person transfer seat of claim 8, wherein the seat mount support is removably coupled to a vertical end bar extending between the second upper support bar and the second lower support bar.

13. The disabled person transfer seat of claim 8, wherein the seat mount support further having a square post, the vertical end bar having a square post receiver attached thereto, and wherein the seat mount support is removably coupled to the vertical end bar through the square post being removably received into the square post receiver.

14. The disabled person transfer seat of claim 8, wherein the first lower support bar is longer than the first upper support bar, the second lower support bar is longer than the second upper support bar, the first upper support bar is not parallel to the first lower support bar and the second upper support bar is not parallel to the second lower support bar.

15. A disabled person transfer seat comprising:

a first vertically oriented bar having at least a first horizontal pivot;

a first structural support section vertically mounted to the first horizontal pivot, the first structural support section comprising a first upper support bar, a first lower support bar, and a first brace plate spanning a vertical distance between the first upper support bar and the first lower support bar, and a second horizontal pivot at an end of the first structural support section opposite the first horizontal pivot;

a second structural support section vertically mounted to the second horizontal pivot, the second structural support section comprising a second upper support bar, a second lower support bar, and a second brace plate spanning a vertical distance between the second upper support bar and the second lower support bar, and a seat mount support on an end of the second structural support section opposite the second horizontal pivot; and a removable seat horizontally pivotally coupled to the seat mount support.

16. The disabled person transfer seat of claim 15, wherein the removable seat further comprises:

a seat frame removably coupled to the seat mount support;

a seat body coupled to the seat frame and having an open center; and first and second hand rails respectively coupled to opposing sides of the seat frame.

17. The disabled person transfer seat of claim 15, wherein the first structural support section and the second structural support section are configured to pivotally rotate in relation to each other to a position where at least a portion of the second structural support section is nested within a portion of the first structural support section.

18. The disabled person transfer seat of claim 15, wherein the first brace plate covers a majority of a first vertical space between the first upper support bar and the first lower support bar, and wherein the second brace plate covers a majority of a second vertical space between the second upper support bar and the second lower support bar.

19. The disabled person transfer seat of claim 15, wherein the seat mount support further having a square post, the vertical end bar having a square post receiver attached thereto, and wherein the seat mount support is removably coupled to the vertical end bar through the square post being removably received into the square post receiver.

20. The disabled person transfer seat of claim 15, wherein the first lower support bar is longer than the first upper support bar, the second lower support bar is longer than the second upper support bar, the first upper support bar is not parallel to the first lower support bar and the second upper support bar is not parallel to the second lower support bar.

* * * * *